US009643764B1

(12) United States Patent
Huang

(10) Patent No.: US 9,643,764 B1
(45) Date of Patent: May 9, 2017

(54) CABLE TIE

(71) Applicant: Ming-Te Huang, Taichung (TW)

(72) Inventor: Ming-Te Huang, Taichung (TW)

( * ) Notice: Subject to any disclaimer, the term of this patent is extended or adjusted under 35 U.S.C. 154(b) by 0 days.

(21) Appl. No.: 15/187,178

(22) Filed: Jun. 20, 2016

(51) Int. Cl.
*B65D 63/10* (2006.01)

(52) U.S. Cl.
CPC .... *B65D 63/1072* (2013.01); *B65D 2563/107* (2013.01)

(58) Field of Classification Search
CPC ..... B65D 63/1072; B65D 2563/107; B65D 63/1018; B65D 63/1027; B65D 63/1063; B65D 63/10; B65D 2563/101; B65D 2563/10; B65D 2563/00
USPC ..... 24/16 PB
See application file for complete search history.

(56) References Cited

U.S. PATENT DOCUMENTS 3,224,056 A * 12/1965 Joffe ..... B65D 63/1072 24/16 PB
3,747,164 A * 7/1973 Fortsch ..... B65D 63/1081 24/16 PB
4,557,023 A * 12/1985 Six ..... B65D 63/1072 24/16 PB
5,224,244 A * 7/1993 Ikeda ..... F16L 3/233 24/16 PB
6,047,448 A * 4/2000 Arnold ..... F16L 3/2336 24/16 PB
6,151,761 A * 11/2000 Thompson ..... E05B 75/00 24/16 PB
6,230,369 B1 * 5/2001 Steadman ..... F16L 3/233 24/16 PB
6,332,248 B1 * 12/2001 Daniggelis ..... B65D 63/1072 24/16 PB
6,507,979 B1 * 1/2003 Thompson ..... E05B 75/00 24/16 PB
2004/0006851 A1 * 1/2004 Pyle ..... B65D 63/1072 24/16 PB
2007/0067965 A1 * 3/2007 Sugiyama ..... B65D 63/14 24/16 PB
2011/0131768 A1 * 6/2011 Watson ..... B65D 63/1063 24/16 PB
2016/0214776 A1 * 7/2016 King ..... B65D 63/1072

* cited by examiner

*Primary Examiner* — Robert J Sandy
*Assistant Examiner* — Rowland Do
(74) *Attorney, Agent, or Firm* — Muncy, Geissler, Olds & Lowe, P.C.

(57) ABSTRACT

A cable tie has a buckle member, an engaging band, and an insertion band. The buckle member has an engaging hole and an engaging block. The engaging block is resilient, is formed in the buckle member, and extends into the engaging hole. The engaging band is selectively inserted into the engaging hole and has two side faces and a thickness. At least one of the side faces has a channel having multiple unidirectional teeth. The insertion band is integrally formed on and extends from the buckle member and has a thickness. The insertion band is stacked with the engaging band when the insertion band and the engaging band are inserted into the engaging hole in the buckle member. The sum of the thicknesses of the insertion band and the engaging band is substantially equal to the height of the engaging hole.

11 Claims, 9 Drawing Sheets

CABLE TIE

BACKGROUND OF THE INVENTION

1. Field of the Invention

The present invention relates to a cable tie, and more particularly to a cable tie that can be used repeatedly.

2. Description of Related Art

A cable tie is applied to bundle multiple wires or cables together. The conventional cable tie as shown in Taiwan Utility Model No. M397949 or China Patent No. 20041010062 substantially comprises an engaging band and a buckle member. The engaging band has unidirectional teeth and is inserted into an engaging hole defined in the buckle member. The buckle member has an engaging block selectively engaged with the unidirectional teeth on the engaging band. With the engagement between the engaging block and the unidirectional teeth, the engaging band can only be moved relative to the buckle member in a unidirectional way to securely bundle the wires or cables together.

However, the conventional engaging band is integrally connected with the buckle member and can be inserted into the engaging hole in the buckle member along one single direction. Therefore, the conventional cable tie can only be used one time but cannot be used repeatedly. After cables or wires are bundled by the conventional cable tie, the cable tie has to be cut off for changing the number of the cables or wires being bundled. The cable tie cannot be released manually, so the cable tie has to be cut off and this is wasteful in use. In addition, the engaging band of the conventional cable tie is integrally connected with the buckle member and has a fixed length, so the conventional cable tie cannot be applied to bundle cables or wires in a large number or scale beyond the standard capacity. Nevertheless, to bundle cables or wires in a small number or scale, the engaging band may be cut off to fit with the small number or scale of objects, and this is also wasteful in use.

To overcome the shortcomings, the present invention tends to provide a cable tie to mitigate or obviate the aforementioned problems.

SUMMARY OF THE INVENTION

The main objective of the invention is to provide a cable tie that can be used repeatedly.

The cable tie has a buckle member, an engaging band, and an insertion band. The buckle member is plastic and has an engaging hole and an engaging block. The engaging hole is defined through the buckle member and has a width and a height. The engaging block is resilient, is formed in the buckle member, and extends into the engaging hole. The engaging band is selectively inserted into the engaging hole in the buckle member and has two side faces, a width, and a thickness. At least one of the side faces has a channel defined in and along the side face and having multiple unidirectional teeth formed in the channel. The insertion band is integrally formed on and extends from the buckle member and has a free end and a thickness. The free end of the insertion band is provided with a guiding head and selectively inserted into the engaging hole. The insertion band is stacked with the engaging band when the insertion band and the engaging band are inserted into the engaging hole in the buckle member. The sum of the thicknesses of the insertion band and the engaging band is substantially equal to the height of the engaging hole.

Other objects, advantages and novel features of the invention will become more apparent from the following detailed description when taken in conjunction with the accompanying drawings.

DETAILED DESCRIPTION OF PREFERRED EMBODIMENT

Figure 1:
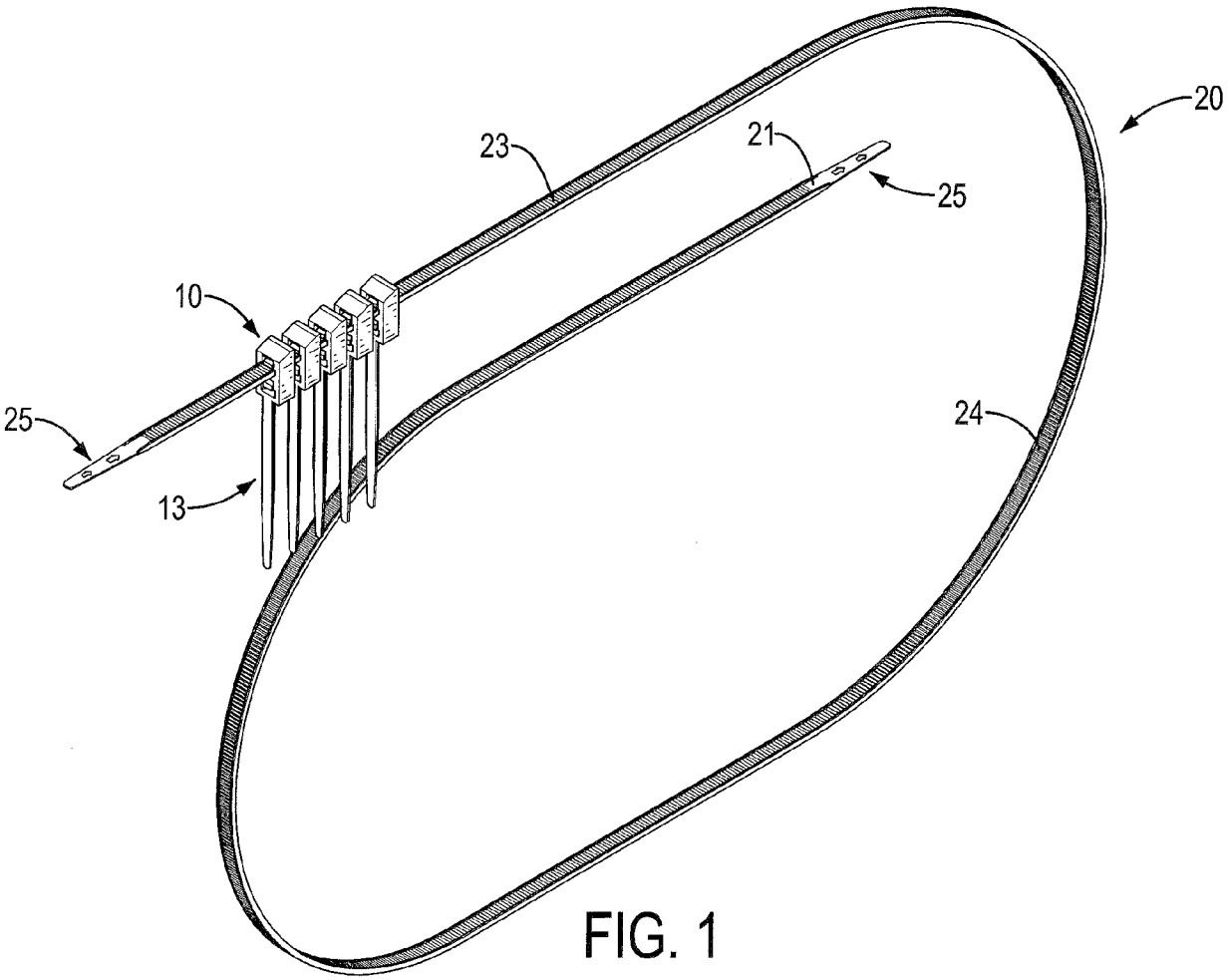
FIG. 1 is a perspective view of a first embodiment of a cable tie in accordance with the present invention.
Figure 2:
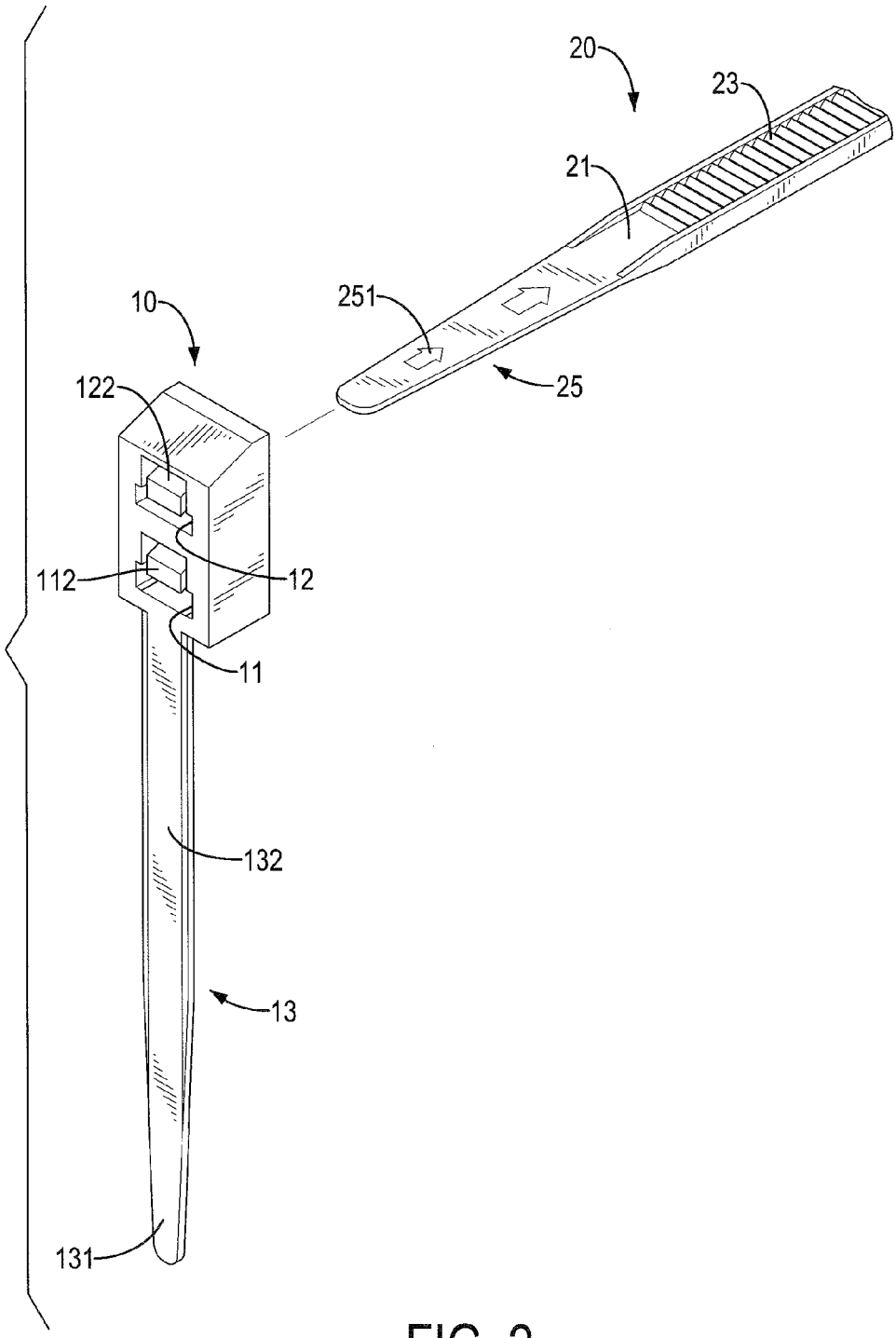
FIG. 2 is an enlarged perspective view of the cable tie in FIG. 1.
Figure 3:
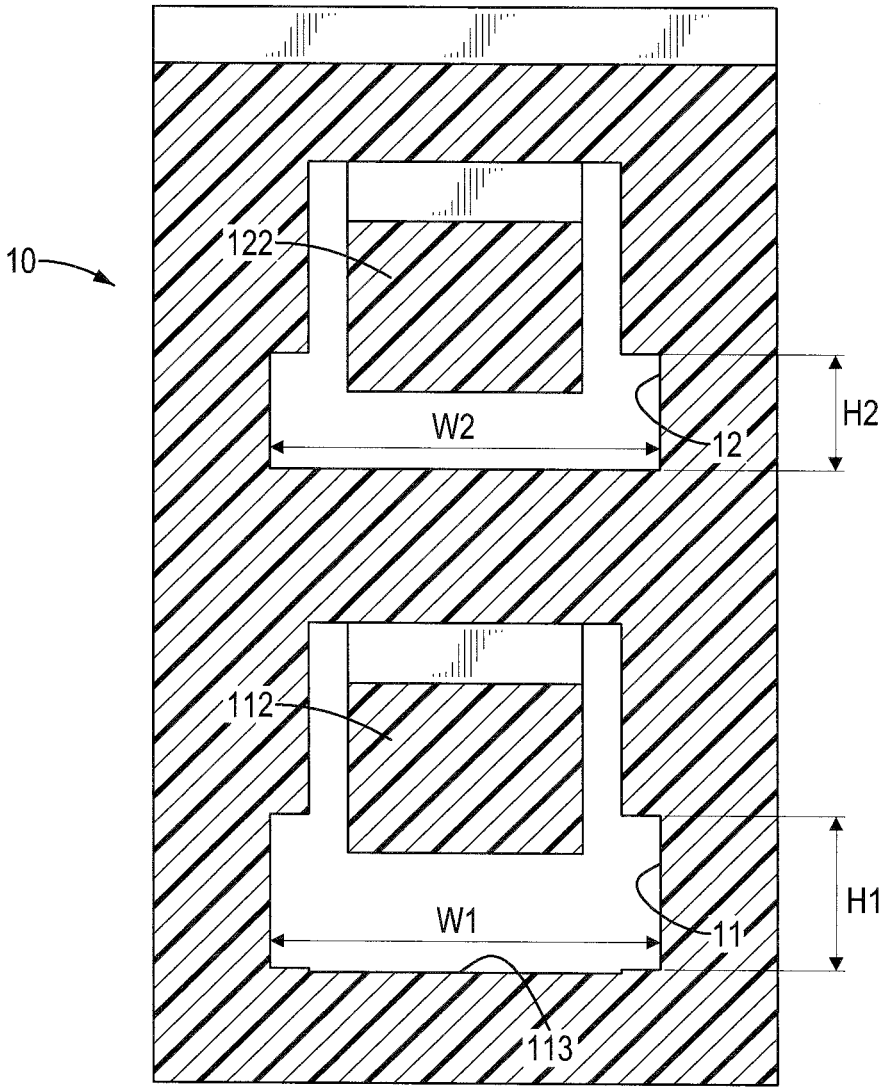
FIG. 3 is an enlarged cross sectional front view of the buckle member of the cable tie in FIG. 1.

With reference to FIGS. 1 to 5, a cable tie in accordance with the present invention comprises a buckle member 10, an engaging band 20, and an insertion band 13.

The buckle member 10 is plastic, is formed as a single part, and has an engaging hole 11, an engaging block 112, a securing hole 12, and a securing block 122. The engaging hole 11 is defined through the buckle member 10 and has a width W1 and a height H1. The engaging block 112 is resilient, is formed in the buckle member 10, and extends into the engaging hole 11. The engaging block 112 has multiple unidirectional teeth formed on the engaging block 112. In addition, the engaging hole 11 has a guiding recess 113 defined in a side of the engaging hole 11 opposite the engaging block 112. The guiding recess 113 has a width smaller than the width W1 of the engaging hole 11.

The securing hole 12 is defined through the buckle member 10, is juxtaposed to the engaging hole 11, and has a width W2 and a height H2. The securing block 122 is resilient, is formed in the buckle member 10, and extends into the securing hole 12.

The engaging band 20 is selectively inserted into the engaging hole 11 and the securing hole 12 in the buckle member 10 and has two ends, two side faces, a width W3, and a thickness T1. The two ends of the engaging band 20 are free ends and are each provided with a guiding tip 25. Each guiding tip 25 has a guiding symbol 251 formed on the guiding tip 25. The width W3 of the engaging band 20 corresponds to and is substantially equal to the width W1 of the engaging hole 11 and the width W2 of the securing hole 12. The thickness T1 of the engaging band 20 corresponds to and is substantially equal to the height H2 of the securing hole 12 and is smaller than the height H1 of the engaging hole 11. At least one of the side faces of the engaging band 20 has a channel 21, 22 defined in and along the side face and having multiple unidirectional teeth 23, 24 formed in the channel 21, 22. Preferably, each of the two side faces of the engaging band 20 has a channel 21, 22 defined in and along the side face. The unidirectional teeth 23, 24 on the two side faces of the engaging band 20 respectively move in a direction opposite each other.

The insertion band 13 is integrally formed on and extends from the buckle member 10 and has a free end, a thickness T2, and two side faces. The free end of the insertion band 13 is provided with a guiding head 131 and is selectively inserted into the engaging hole 11. The insertion band 13 is stacked with the engaging band 20 when the insertion band 13 and the engaging band 20 are inserted into the engaging hole 11 in the buckle member 10. The sum of the thicknesses T1,T2 of the insertion band 13 and the engaging band 20 is substantially equal to the height H1 of the engaging hole 11. In addition, at least one of the side faces of the insertion band 13 has a guiding protrusion 132 formed on and along the side face and selectively held in the guiding recess 113 in the engaging hole 11. Preferably, each of the two side faces of the insertion band 13 has a guiding protrusion 132 formed on and along the side face.

With reference to FIGS. 2, 4, 5, and 7, in use, one of the free ends of the engaging band 20 is inserted into the securing hole 12 in the buckle member 10. With the engagement between the unidirectional teeth on the engaging band 20 and the securing block 122, the engaging band 20 is kept from disengaging from the securing hole 12. The other free end is mounted around and encircles multiple objects, such as wires or cables, and is then inserted into the engaging hole 11. Because the thickness T1 of the engaging band 20 is smaller than the height H1 of the engaging hole 11, the engaging band 20 is allowed to move relative to the engaging hole 11 in two opposite directions to adjust the length of the engaging band 20 for encircling the objects. Then, the insertion band 13 is inserted into the engaging hole 11 and is stacked with the engaging band 20. Because the sum of the thicknesses T1,T2 of the engaging band 20 and the insertion band 13 is substantially equal to the height H1 of the engaging hole 11, the unidirectional teeth 23, 24 on one side face of the engaging band 20 can engage with the unidirectional teeth on the engaging block 112. With the engagement of the unidirectional teeth 23,24 on the engaging band 20 and the engaging block 112, the engaging band 20 is kept from disengaging from the engaging hole 11. Thus, objects can be securely encircled and bundled by the engaging band 20.

Figure 6:
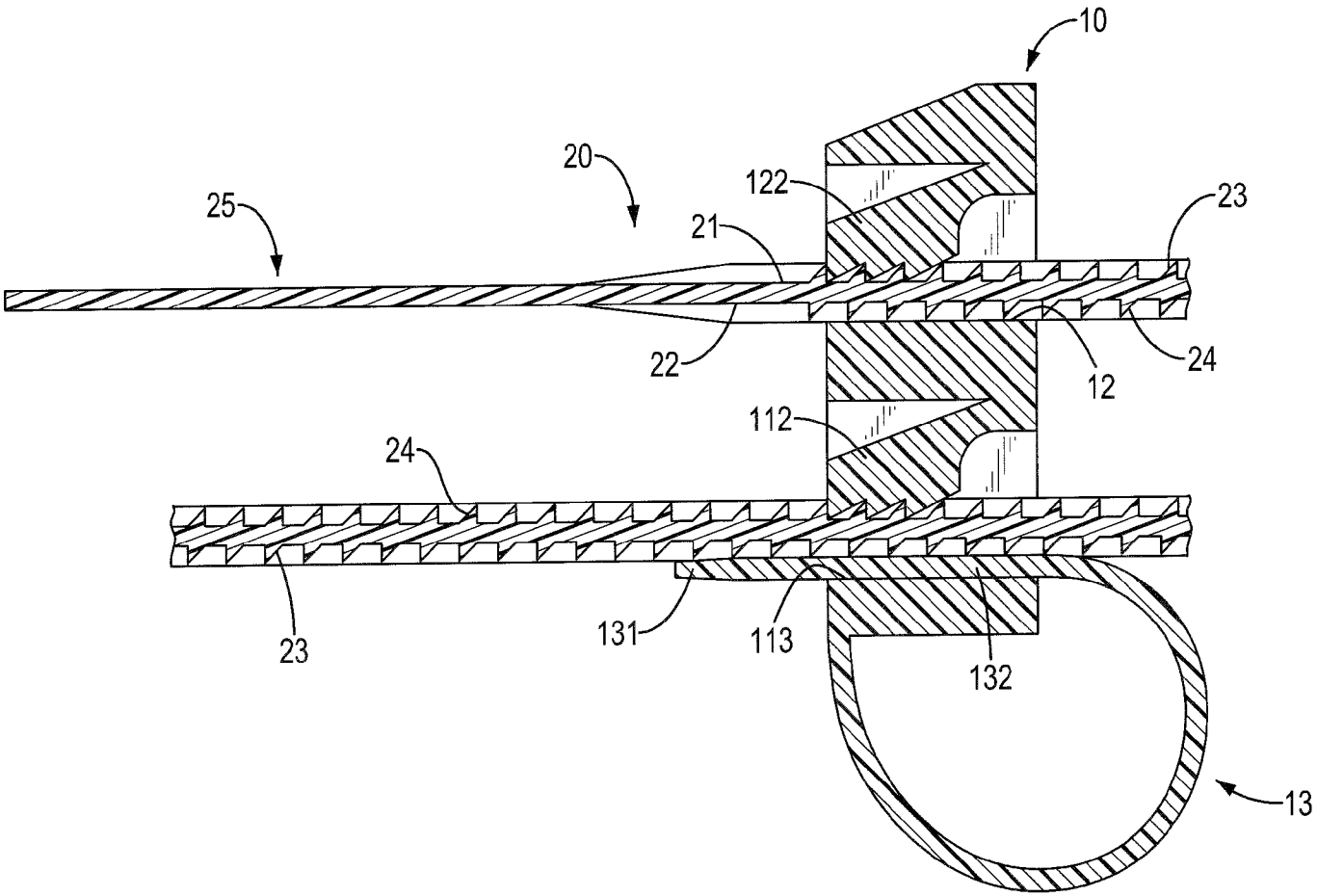
FIG. 6 is another enlarged operational cross sectional side view of the cable tie in FIG. 1.
Figure 7:
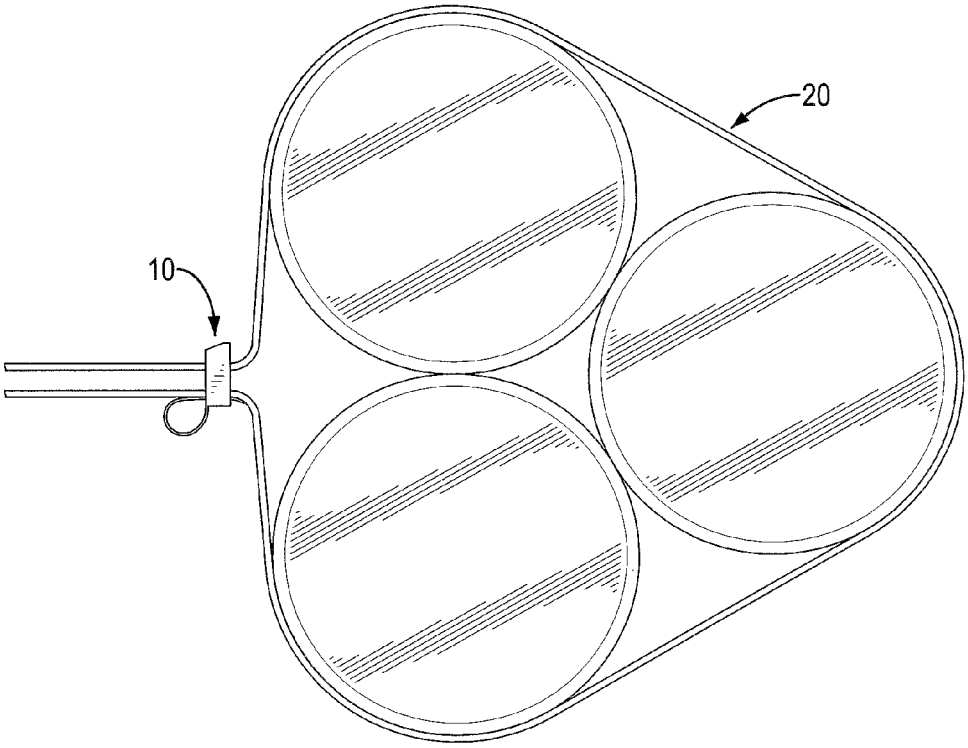
FIG. 7 is an operational side view of the cable tie in FIG. 1.

To release the objects, the insertion band 13 is first disengaged from the engaging hole 11, and the engaging band 20 can be disengaged from the engaging block 112. Thus, the engaging band 20 can be moved relative to the engaging hole 11 in two directions and even be released from the engaging hole 11, such that the length of the engaging band 20 for bundling objects can be changed. Consequently, the numbers and positions of the objects bundled by the cable tie in accordance with the present invention can be changed. Accordingly, the cable tie in accordance with the present invention can be repeatedly used without using tools and is convenient and versatile in use. In addition, with the arrangement of the guiding recess 113 in the engaging hole 11, the guiding protrusions 132 on two side faces of the engaging band 13 can be respectively held in the guiding recess 113 and the channel 21,22 in one side face of the engaging band 20. Thus, the engaging band 20 can be well supported by the insertion band 13. The insertion band 13 can be inserted into the engaging hole 11 smoothly in two opposite directions as shown in FIGS. 4 and 6, such that the cable tie in accordance with the present invention is convenient in use.

Figure 4:
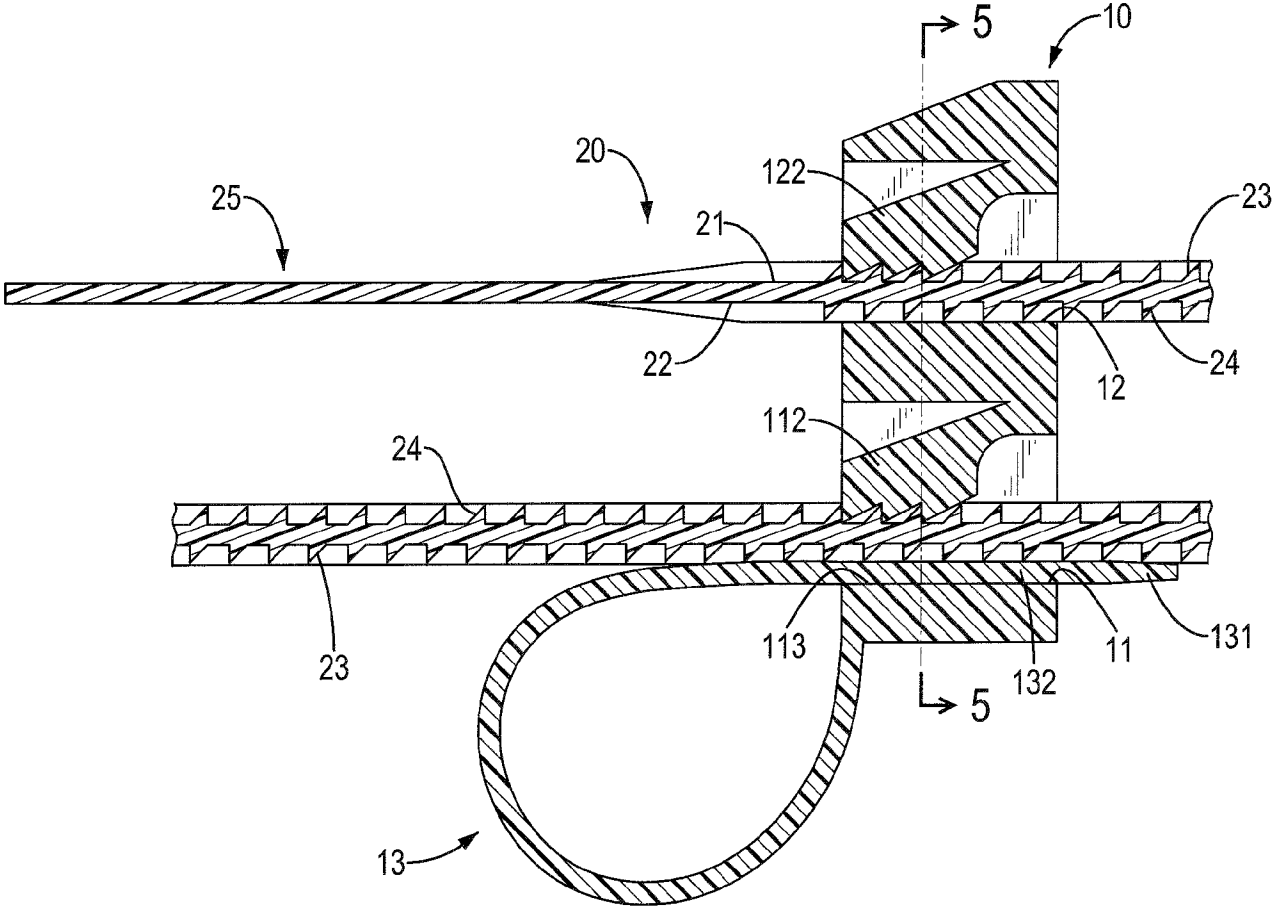
FIG. 4 is an enlarged operational cross sectional side view of the cable tie in FIG. 1.
Figure 5:
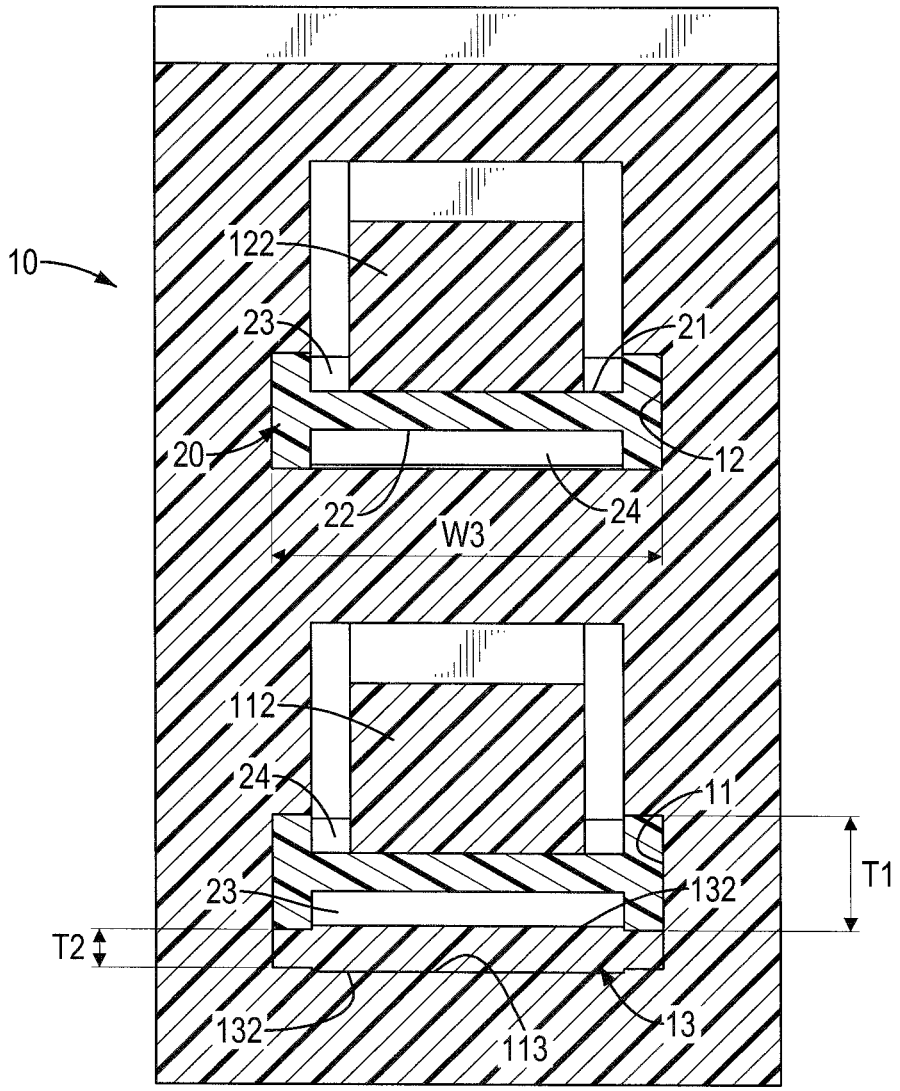
FIG. 5 is an enlarged cross sectional front view of the cable tie along the line 5-5 in FIG. 1.

With reference to FIGS. 1 and 4, because the engaging band 20 is an individual element independent from the buckle member 10, the engaging bands 20 with different lengths can be chosen to bundle objects in different numbers and scales.

Figure 8:
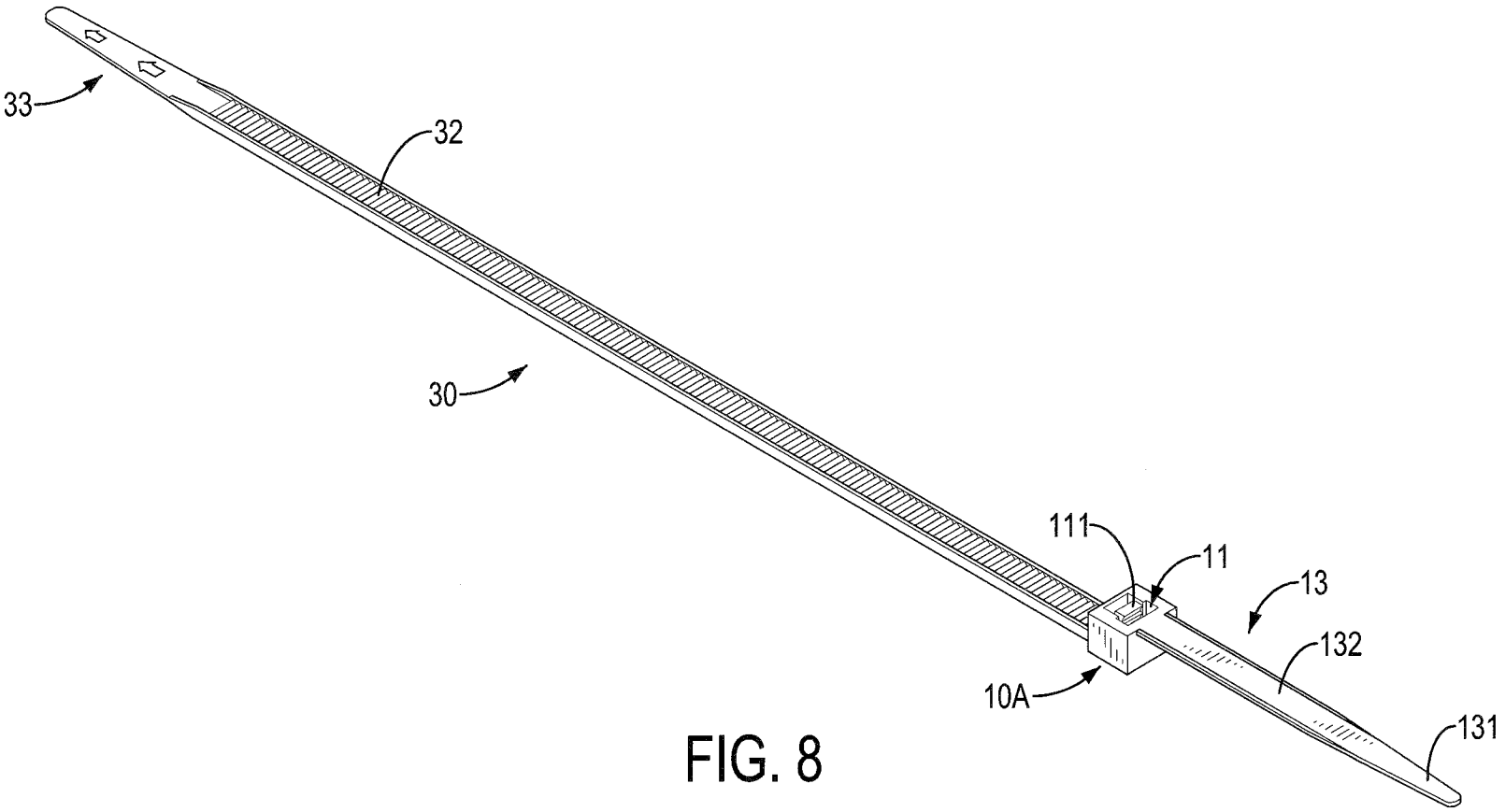
FIG. 8 is a perspective view of a second embodiment of a cable tie in accordance with the present invention.
Figure 9:
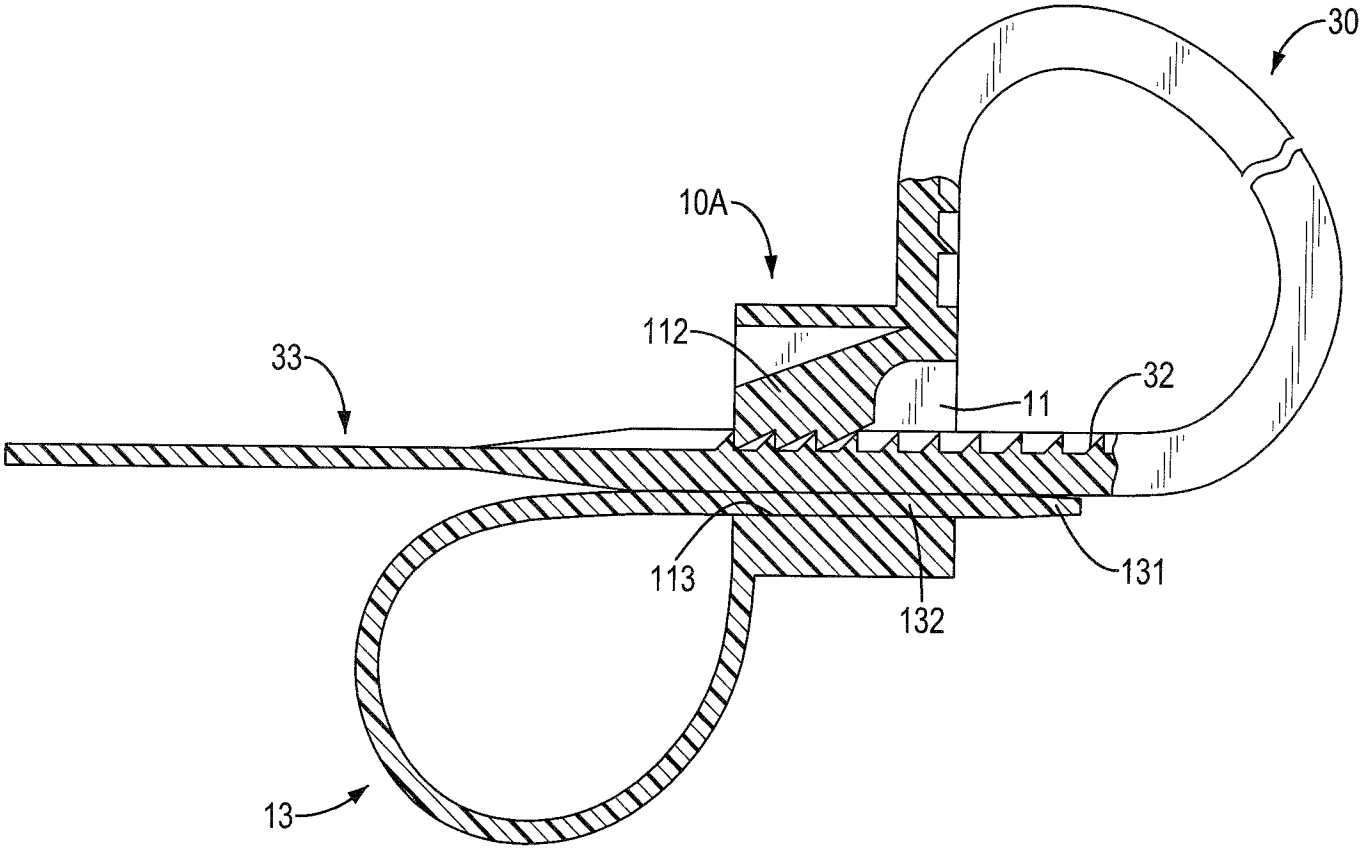
FIG. 9 is an enlarged operational cross sectional side view of the cable tie in FIG. 8.

With reference to FIGS. 8 and 9, in the second embodiment, the buckle member 10A only has the engaging hole 11 and the engaging block 112. One of the ends of the engaging band 30 is integrally connected with the buckle member 10A, and the other end of the engaging band is a free end provided with a guiding tip 33.

In use, the free end of the engaging band 30 is mounted around and encircles objects and is then inserted into the engaging hole 11. Then, the insertion band 13 is inserted into the engaging hole 11 to enable the unidirectional teeth 32 on the engaging band 30 to engage with the engaging block 112. Accordingly, objects can be securely bundled by the engaging band 30. To release the objects from the cable tie in accordance with the present invention, the insertion band 13 is disengaged from the engaging hole 11 in the buckle member 10A and the engaging band 30 can also be disengaged and released from the engaging hole 11. Accordingly, the cable tie can be used repeatedly.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable tie comprising:

a buckle member being plastic and having an engaging hole defined through the buckle member and having a width and a height; and an engaging block being resilient, formed in the buckle member, and extending into the engaging hole;

an engaging band selectively inserted into the engaging hole in the buckle member and having two side faces, a width, and a thickness, wherein at least one of the two side faces has a channel defined in and along the side face and having multiple unidirectional teeth formed in the channel; and an insertion band integrally formed on and extending from the buckle member and having a free end provided with a guiding head and selectively inserted into the engaging hole; and a thickness, wherein the insertion band is stacked with the engaging band when the insertion band and the engaging band are inserted into the engaging hole in the buckle member; and a sum of the thicknesses of the insertion band and the engaging band is substantially equal to the height of the engaging hole.

2. The cable tie as claimed in claim 1, wherein the engaging hole has a guiding recess defined in a side of the engaging hole opposite the engaging block; and the insertion band has two side faces and at least one of the two side faces of the insertion band has a guiding protrusion formed on and along the side face and selectively held in the guiding recess in the engaging hole.

3. The cable tie as claimed in claim 2, wherein the engaging band has two ends, one of the two ends is integrally connected with the buckle member, and the other end is a free end and is provided with a guiding tip.

4. The cable tie as claimed in claim 1, wherein the engaging band has two ends, one of the two ends is integrally connected with the buckle member, and the other end is a free end and is provided with a guiding tip.

5. The cable tie as claimed in claim 1, wherein the buckle member further has a securing hole defined through the buckle member, juxtaposed to the engaging hole, and having a width and a height; and a securing block being resilient, formed in the buckle member, and extending into the securing hole; and the width and the height of the securing hole correspond to the width and the thickness of the engaging band.

6. The cable tie as claimed in claim 5, wherein the engaging band is an individual element independent from the buckle member.

7. The cable tie as claimed in claim 6, wherein the engaging hole has a guiding recess defined in a side of the engaging hole opposite the engaging block; and the insertion band has two side faces and at least one of the two side faces of the insertion band has a guiding protrusion formed on and along the side face and selectively held in the guiding recess in the engaging hole.

8. The cable tie as claimed in claim 6, wherein each one of the two side faces of the engaging band has a channel defined in and along the side face; and each channel has multiple unidirectional teeth formed in the channel.

9. The cable tie as claimed in claim 8, wherein the engaging hole has a guiding recess defined in a side of the engaging hole opposite the engaging block; and the insertion band has two side faces and each one of the two side faces of the insertion band has a guiding protrusion formed on and along the side face and selectively held in the guiding recess in the engaging hole.

10. The cable tie as claimed in claim 9, wherein the unidirectional teeth on the two side faces of the engaging band respectively move in a direction opposite each other.

11. The cable tie as claimed in claim 10, wherein the engaging band has two ends each provided with a guiding tip; and each guiding tip has a guiding symbol formed on the guiding tip.

* * * * *